US006464386B1

(12) United States Patent
Oota et al.

(10) Patent No.: US 6,464,386 B1
(45) Date of Patent: Oct. 15, 2002

(54) METHOD AND APPARATUS FOR MIXING POWDER WITH LIQUID

(75) Inventors: Akiyasu Oota, Sanda (JP); Akihito Tsujimoto, Wakayama (JP); Katsumi Okayama, Kusatsu (JP)

(73) Assignee: Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/513,085

(22) Filed: Feb. 25, 2000

(30) Foreign Application Priority Data

Feb. 26, 1999 (JP) ..... 11-050171

(51) Int. Cl.[7] ..... B01F 11/00; B01F 15/02

(52) U.S. Cl. ..... 366/239; 366/167.1; 366/185

(58) Field of Search ..... 36/2, 26, 55, 45, 36/185, 216, 217, 218, 219, 239, 114, 167.1; 68/172, 173, 17 R

(56) References Cited

U.S. PATENT DOCUMENTS 1,825,614 A * 9/1931 Eggert ..... 366/40
2,273,750 A * 2/1942 Clagett, Jr. ..... 366/185
2,352,362 A * 6/1944 Bassett, Jr.
2,471,433 A * 5/1949 Kahn
2,502,053 A * 3/1950 Mnley
2,520,685 A * 8/1950 Horvath
3,132,848 A * 5/1964 Garlinghouse ..... 366/239
3,706,443 A * 12/1972 Oberhauser ..... 366/216
3,888,468 A * 6/1975 Albin ..... 366/45
4,415,270 A * 11/1983 Heinis et al. ..... 366/216
4,490,047 A * 12/1984 Stegemoeller et al. ..... 366/239
4,900,154 A * 2/1990 Waitzinger et al. ..... 366/40
5,833,364 A * 11/1998 Rushing et al. ..... 366/152.1

FOREIGN PATENT DOCUMENTS

JP 5-38829 9/1993

* cited by examiner

*Primary Examiner*—Tony G. Soohoo
(74) *Attorney, Agent, or Firm*—Armstrong, Westerman & Hattori, LLP.

(57) ABSTRACT

A mixing apparatus comprises a mixing container having an opening. The mixing container is hollow cylindrical, having a length 1.5~2.5 times an inner diameter. The mixing container is loaded with a powder such as a metallurgical powder to 30 % ~80% of the capacity of the mixing container. The mixing container is tilted at 10 degrees ~40 degrees off the horizontal level and rotated while a liquid such as a lubricant is supplied to the powder in the mixing container from a nozzle portion. The nozzle portion is constituted to prevent the liquid from discharging when the supply of the liquid is not needed. After the liquid is supplied, the nozzle portion is evacuated from the mixing container while the mixing container is rocked for mixing the powder with the liquid. Thereafter, the mixing container is tilted to position the opening at a downward location, and the mixing container is given rotation and impact while unloading a mix from within the mixing container.

13 Claims, 9 Drawing Sheets

METHOD AND APPARATUS FOR MIXING POWDER WITH LIQUID

BACKGROUND OF THE INVENTION

1. Field of the Invention

The present invention relates to a method and an apparatus for mixing a powder with a liquid, and more specifically to a method and an apparatus for mixing a powder with a liquid by spraying the liquid to the powder loaded in a mixing container and rocking the container, a mix manufactured by the method, and a compact and a sintered body obtained from the mix.

2. Description of the Related Art

According to a conventional method of mixing of this kind, as disclosed in the Publication No. 5-38829 of Examined Japanese Utility Model Application for example, the powder is loaded into the container, and the container is rotated and rocked while the liquid is being sprayed from a nozzle disposed generally at a center portion of the container, thereby agitating the powder in the container for mixing with the liquid.

However, according to such a method as above, since the container is rotated and rocked while the liquid is being sprayed from the nozzle, there is much opportunity for the nozzle to be contacted by the powder. When the powder contacts the nozzle, the powder sticks to the nozzle, partially clogging a spraying port, making impossible to maintain uniformity in the spraying, leading to a problem of poor mixing. Another problem is that the powder stuck to the nozzle absorbs the liquid excessively, making localized doughy mass.

SUMMARY OF THE INVENTION

It is therefore a primary object of the present invention to provide a method and an apparatus for mixing the powder with the liquid capable of avoiding the non-uniform supply of the liquid caused by the powder covering the spraying port of the liquid, and preventing the liquid from dripping out of the spraying port.

Another object of the present invention is to provide a mix manufactured by the above method, and a compact and a sintered body obtained from the mix.

According to an aspect of the present invention, there is provided a method for mixing a powder with a liquid, comprising; a first step of supplying the liquid to the powder in a mixing container by a supplying portion exposed to an inside of the mixing container, and a second step of mixing the powder with the liquid by rocking the mixing container.

According to the present invention, the step of supplying the liquid toward a surface of the powder and the step of mixing the powder with the liquid are different steps separated from each other. Specifically, the powder is mixed with the liquid after a desired amount of the liquid is supplied. When the step of mixing the powder with the liquid starts, the supply of the liquid is already finished, and therefore, the powder does not stick to the supplying portion when the liquid is supplied, and the liquid can be supplied uniformly to the surface of the powder. Thus, the non-uniform supply of the liquid caused by the powder covering the supplying port of the liquid and dripping of the liquid from the supplying port can be avoided, thereby preventing the formation of the localized doughy mass, making possible to mix the powder with the liquid efficiently and uniformly.

According to the present invention, preferably, in the second step, the powder is mixed with the liquid after the supplying portion has been evacuated from the mixing container. With this arrangement, it becomes possible to prevent the powder from sticking to the supplying portion. Therefore, the supply portion is not worn by the powder, making possible to extend the life of the supplying portion.

Further, preferably, the mixing container is tilted at 10 degrees~40 degrees off the horizontal level while the liquid is supplied to the powder. In this case, the liquid can be supplied more uniformly to the surface of the powder. Therefore, when the powder is mixed with the liquid, the formation of the localized doughy mass caused by non-uniform supply of the liquid is prevented, making possible to mix the powder with the liquid more efficiently and uniformly.

Further, preferably, the mixing container is hollow cylindrical having a length 1.5~2.5 times an inner diameter, and loaded with the powder to 30%~80% of the capacity of the mixing container. By supplying the liquid toward the surface of the powder under this condition, the liquid can be supplied more uniformly to the surface of the powder. Therefore, when the powder is mixed with the liquid, the formation of the localized doughy mass caused by non-uniform supply of the liquid is prevented, making possible to mix the powder with the liquid furthermore efficiently and uniformly.

Preferably, the mixing container includes an opening, and the method further comprises a third step after the second step, of unloading a mix from within the mixing container while giving the mixing container rotation and impact as well as tilting the mixing container to position the opening at a downward location. With this arrangement, the mix in the mixing container can be unloaded efficiently, reducing a residue remaining in the mixing container, guaranteeing the uniform mixing in the mixing operation in the next cycle.

Further, preferably, the mixing container is rotated while the liquid is supplied. In this case, the liquid can be supplied uniformly to the surface of the powder. This is especially effective when a large amount of the liquid is supplied, since the liquid can be supplied to the whole mass of the powder. Further, by rotating but not rocking the mixing container, the powder can be prevented from sticking to the supplying portion.

Further, preferably, the powder includes a metallurgical powder, and the liquid includes at least either one of a lubricant and a binder. In this case, if the method for mixing a powder with a liquid described as above is applied, a uniform mixing can be achieved, making possible to prevent failures such as breakage after sintering.

Preferably, the metallurgical powder includes a rare-earth alloy. The rare-earth alloy is highly abrasive, being apt to wear the mixing container. However, according to the above method for mixing a powder with a liquid, it becomes possible to mix uniformly within a short time. Therefore, even when the rare-earth alloy is mixed, it becomes possible to reduce the wear in the mixing container to a very low level.

According to another aspect of the present invention, there is provided a mix of a powder and a liquid obtained by; first supplying the liquid to the powder in a mixing container from a supplying portion exposed to an inside of the mixing container, and then mixing the powder with the liquid by rocking the mixing container. If a mix is manufactured in such a method as above, the mix is uniformly mixed.

According to still another aspect of the present invention, there is provided a compact manufactured from a mix obtained by; first supplying a liquid to a powder in a mixing container from a supplying portion exposed to an inside of the mixing container, and then mixing the powder with the liquid by rocking the mixing container. If such a mix as above is used, it becomes possible to reduce breakage and cracking of the compact at a time of pressing, making possible to improve yield of the compact.

According to still another aspect of the present invention, there is provided a sintered body manufactured from a mix obtained by; first supplying a liquid to a powder in a mixing container from a supplying portion exposed to an inside of the mixing container, and then mixing the powder with the liquid by rocking the mixing container. If such a mix as above is used, it becomes possible to reduce breakage and cracking of the compact at a time of sintering the compact, making possible to improve yield of the sintered body.

According to still another aspect of the present invention, there is provided an apparatus for mixing a powder with a liquid, comprising; a mixing container for holding the powder, a supplying portion exposed to an inside of the mixing container when the liquid is supplied to the mixing container while being evacuated from the mixing container when the powder is mixed with the liquid within the mixing container, and a rocking portion for rocking the mixing container for mixing the powder and the liquid. If this mixing apparatus is used, the powder can be mixed uniformly with the liquid.

According to the present invention, preferably, the supplying portion is constituted to prevent the liquid from discharging when the supply of the liquid is not needed. Since the supplying portion can prevent the discharge of the liquid when the supply of the liquid is not needed, it becomes possible to prevent dripping of the liquid from the end portion of the supplying portion after a desired amount of the liquid has been supplied. Therefore, the formation of the localized doughy mass caused by the dripping liquid can be prevented, and the powder can be mixed with the liquid efficiently and uniformly.

Further, preferably, the supplying portion includes a cylindrical spray tube having an end portion provided with a supplying port, a stop rod axially slidable within the spray tube, an urging portion urging the stop rod in a direction for closing the supplying port, and a first pressurizing portion opening the supplying port by application of a pressure in the opposite direction of the urge. In this case, since the urging portion always urges the stop rod in the direction for closing the supplying port, and the port is opened by the pressure in the opposite direction of the urge when the liquid is supplied, it becomes possible to prevent the liquid remaining in the spray tube from dripping out of the supplying port when the supply is stopped.

Further, preferably, the apparatus further comprises a second pressurizing portion applying a back pressure to the liquid for supply of the liquid to the supplying portion. As described above, since the supply of the liquid to the supply portion is performed by addition of the back pressure, and the stopping of the supply is made by closing the supplying port, it becomes possible to keep a constant pressurization to the liquid, making possible to prevent pulsing in the liquid. Therefore, since a constant state of supply can be maintained, the liquid can be sprayed uniformly.

The object described above, other objects, features, aspects and advantages of the present invention will become clearer from description of an embodiment to be made hereinafter with reference to the attached drawings.

DETAILED DESCRIPTION OF THE PREFERRED EMBODIMENTS

Hereinafter, an embodiment of the present invention will be described with reference to the drawings.

In this embodiment, a powder is a metallurgical powder, and a liquid is a lubricant.

Figure 1:
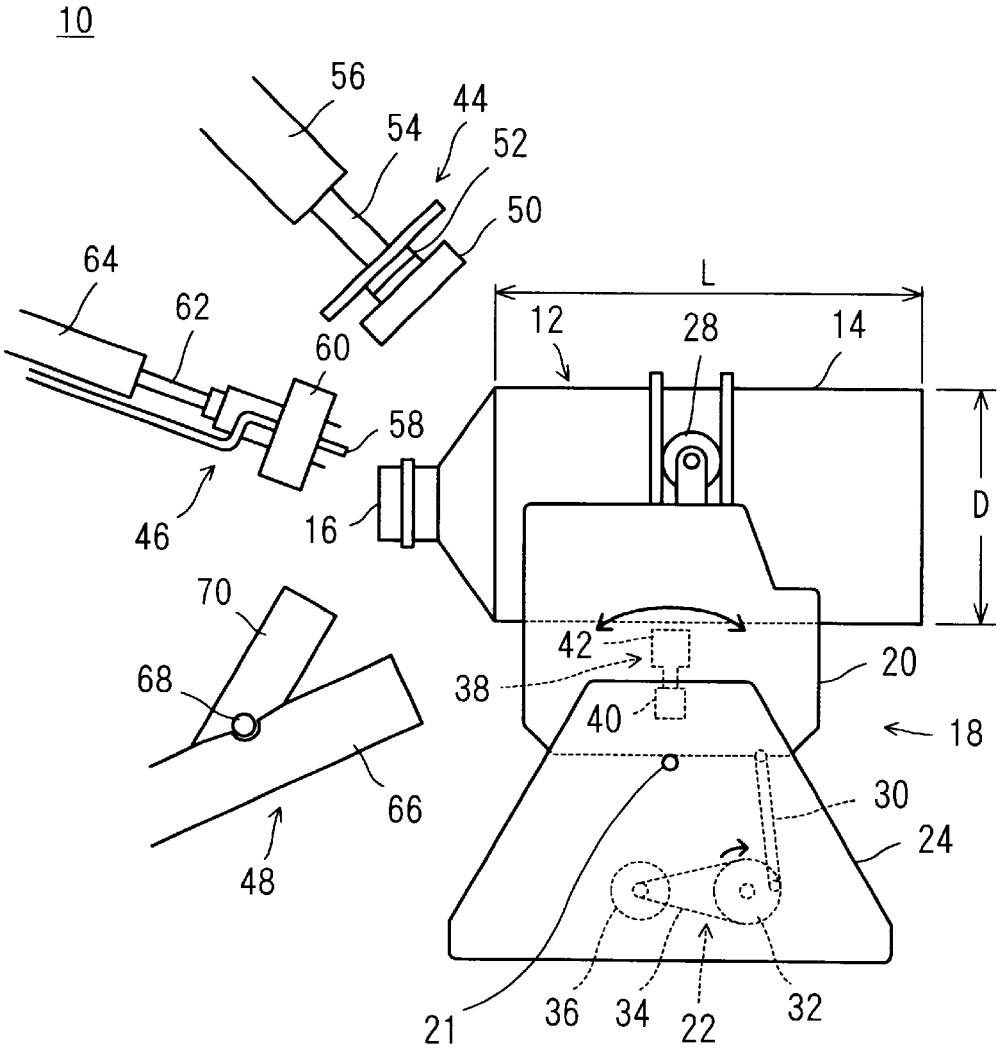
FIG. 1 is a side view showing a general constitution of an embodiment of the present invention.
Figure 2:
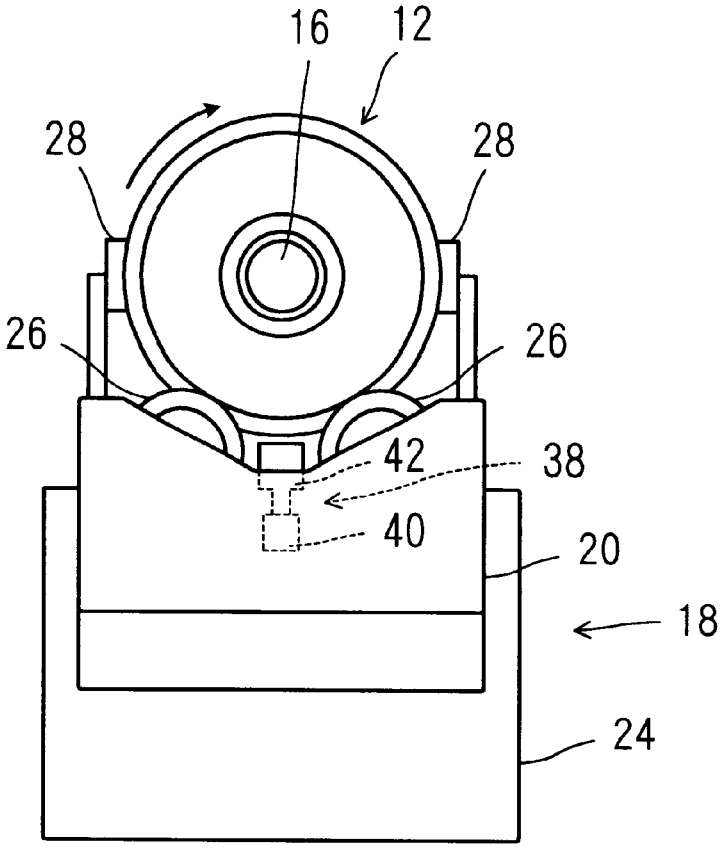
FIG. 2 is a front view showing a state in which the mixing container is mounted in a rotating/rocking portion.

Referring to FIG. 1 and FIG. 2, a mixing apparatus 10 as an embodiment of the present invention comprises a mixing container 12. The mixing container 12 includes a cylindrical barrel 14. The barrel 14 has an end portion formed like a truncated cone having an end portion formed with an opening 16, and another end portion formed generally flat. The mixing container 12 has an inner diameter D and a length L, with L/D being in a range of 1.5~2.5. According to the present embodiment, the dimension D is 1 meter whereas the dimension L is 2 meters.

The mixing container 12 is mounted in a rotating/rocking portion 18. The rotating/rocking portion 18 includes a base frame 20 holding the mixing container 12, a rocking mechanism 22 rocking the base frame 20, and a supporting base 24 supporting the base frame 20 for rocking action. The base frame 20 is provided with rollers 26 for rotating the mixing container 12 about a longitudinal axis of the mixing container 12, and guide rollers 28 holding the mixing container 12 in position. The rotating/rocking portion 22 includes a crank 30. The crank 30 has an end portion linked to the base frame 20, and another end portion linked to a pulley 32. The pulley 32 is connected to an electric motor 36 via a belt 34. Thus, the electric motor 36 drives the belt 34, the pulley 32 and the crank 30, which then rocks the base frame 20 about a fulcrum 21. Further, the rotating/rocking portion 18 includes a hammering mechanism 38 for giving an impact to the mixing container 12. The hammering mechanism 38 includes an air cylinder 40 and a hammer 42 linked to the air cylinder 40. A stroke action of the air cylinder 40 makes the hammer 42 hit the mixing container 12.

Further, there is provided a lid member holding portion 44, a nozzle holding portion 46, and an unloading portion 48 on a side of the mixing container 12 close to the opening 16.

The lid member holding portion 44 includes an attaching/detaching portion 52 capable of holding a lid member 50, and an air cylinder 56 and a cylinder rod 54 as a driving portion capable of moving the attaching/detaching portion 52 toward and away from the opening 16, for attaching and detaching the lid member 50 which closes the opening 16 to and from the opening 16.

The nozzle holding portion 46 includes a nozzle portion 58 as a supplying portion for spraying the lubricant, a cover portion 60 for closing the opening 16 when the nozzle portion 58 is set to the opening 16 of the mixing container 12, and an air cylinder 64 and a cylinder rod 62 as a driving portion capable of moving the nozzle portion 58 and the cover portion 60 toward and away from the opening 16, being capable of setting the nozzle portion 58 to the opening 16.

The unloading portion 48 includes a chute portion 66 and a cover portion 70 provided in the chute portion 66 via a pivoting portion 68, for unloading a mix from the mixing container 12.

Figure 3:
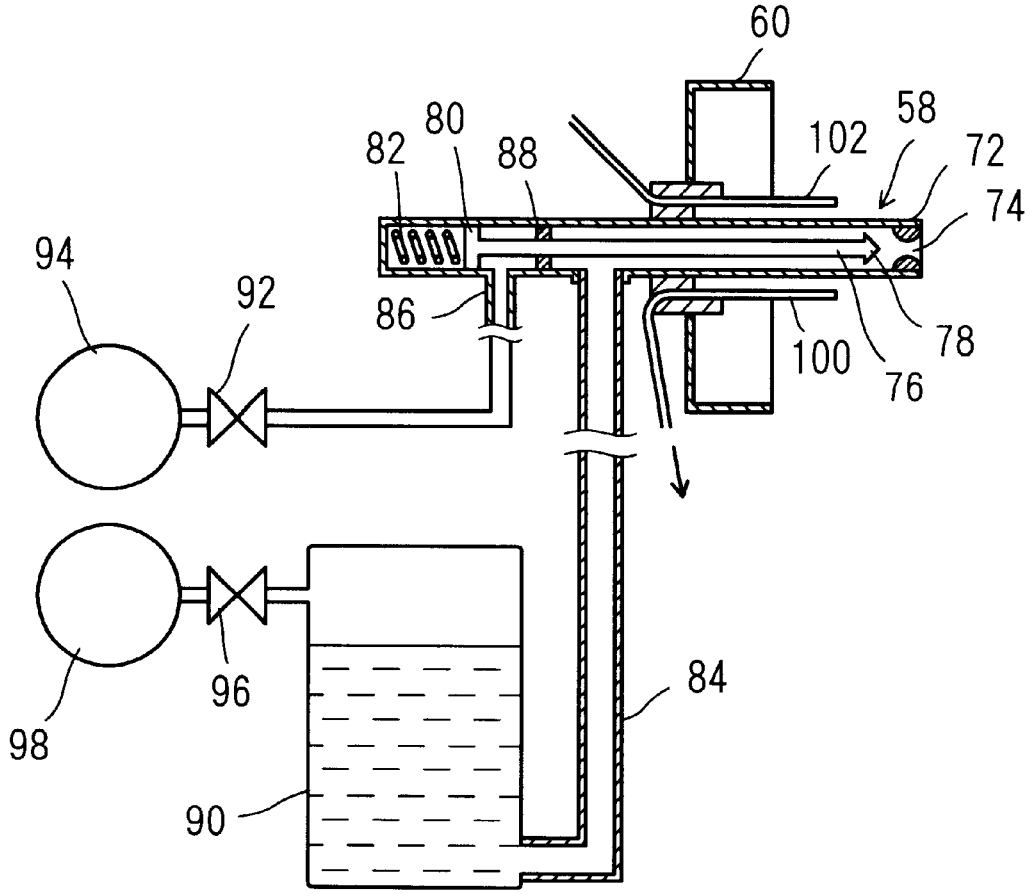
FIG. 3 is a schematic diagram showing a nozzle portion and a spraying mechanism.

Next, description will be made for a constitution of the nozzle portion 58 for spraying the lubricant and a spraying mechanism with reference to FIG. 3.

The nozzle portion 58 is provided at a center portion of the cover portion 60. The nozzle portion 58 includes a hollow cylindrical spray tube 72. The spray tube 72 has a tip portion provided with a spraying port 74. The spray tube 72 has an inside provided with a slidable stop rod 76. The stop rod 76 has a tip portion provided with a conical head portion 78 for closing the spraying port 74. The stop rod 76 has a rear end portion formed with a piston portion 80. The piston portion 80 has a rear end portion provided with a spring 82 serving as an urging portion. The spring 82 constantly urges the piston portion 80 toward the spraying port 74.

The spray tube 72 is provided with a lubricant intake tube 84 and a pressure tube 86. The lubricant intake tube 84 supplies the lubricant to be sprayed, into the nozzle portion 58. The pressure tube 86 supplies a gas into the nozzle portion 58. By controlling the supply of the gas to the nozzle portion 58, the stop rod 76 can be moved to open and close the spraying port 74. It should be noted here that within the spray tube 72, a seal member 88 is provided between an opening of the pressure tube 86 and an opening of the lubricant intake tube 84 for separation between the lubricant coming from the lubricant intake tube 84 and the gas coming from the pressure tube 86.

The lubricant intake tube 84 is connected to a liquid container 90. The pressure tube 86 is connected to a pressurizing tank 94 such as a gas cylinder via a valve 92. The liquid container 90 is connected to a pressurizing apparatus 98 via a pressure controlling valve 96. The liquid container 90 is pressurized by the pressurizing apparatus 98 at a constant pressure.

It should be noted here that a gas relieving tube 100 and a gas supplying tube 102 are provided around the nozzle portion 58.

Now, description will cover a spraying action of the nozzle portion 58 constituted as described above.

First, in a spraying-off state, the valve 92 is closed so that the gas is not supplied from the pressurized tank 94.

In this state, the spring 82 urges the piston portion 80 to press the stop rod 76 to the spraying port 74. Therefore, the head portion 78 of the stop rod 76 contacts the spraying port 74, closing the spraying port 74. Hence, the lubricant in the nozzle portion 58 is not sprayed from the spraying port 74 in this state. It should be noted here that even in this spray-off state, the valve 96 is held open, an inside of the liquid container 90 is under a pressure, and the nozzle portion 58 is filled with the lubricant supplied via the lubricant intake tube 84, holding an inside of the nozzle portion 58 under the pressure.

Next, when the spray is started, the valve 92 is opened so that the gas in the pressurizing tank 94 is supplied into the nozzle portion 58 via the pressure pipe 86. When the pressure of the gas exceeds the urge of the spring 82, the piston portion 80 is moved toward the spring 82. When the piston portion 80 is moved, the stop rod 76 is also moved, opening the spraying port 74, allowing the lubricant to be sprayed from the spraying port 74. When the spray is stopped, the valve 92 is closed again to stop the supply of the gas pressure. At the same time, the pressure applied to the pressure pipe 86 is relieved by the valve 92.

According to this embodiment, the lubricant to be sprayed is always under a constant pressure of the gas from the pressurizing apparatus 98, and starting and stopping of the spray is controlled by another gas pressure, i.e. the pressure of the gas from the pressurizing tank 94. Therefore, it is possible to spray at a constant pressure upon start of the spraying, making possible to maintain a uniform state of spraying without fluctuation.

Further, according to the present embodiment, the spraying port 74 at the tip portion of the nozzle portion 58 is closed by the head portion 78 of the tip portion of the stop rod 76. Thus, it is possible to prevent the lubricant remaining in the nozzle portion 58 from dripping out of the spraying port 74 after the spray is stopped.

Next, description will cover a method of mixing the metallurgical powder with the lubricant by the mixing apparatus 10, with reference to FIG. 4 through FIG. 7.

First, though not illustrated, the mixing container 12 is loaded with the metallurgical powder. At this time, the metallurgical powder fills 30%~80% of the capacity of the mixing container 12. Preferably, the metallurgical powder should fill 40%~60% of the capacity of the mixing container 12. The mixing container 12 loaded with a predetermined amount of the metallurgical powder is then moved by a conveyer (not illustrated) and mounted in the rotating/rocking portion 18.

Next, the metallurgical powder is sprayed with the lubricant.

Figure 4:
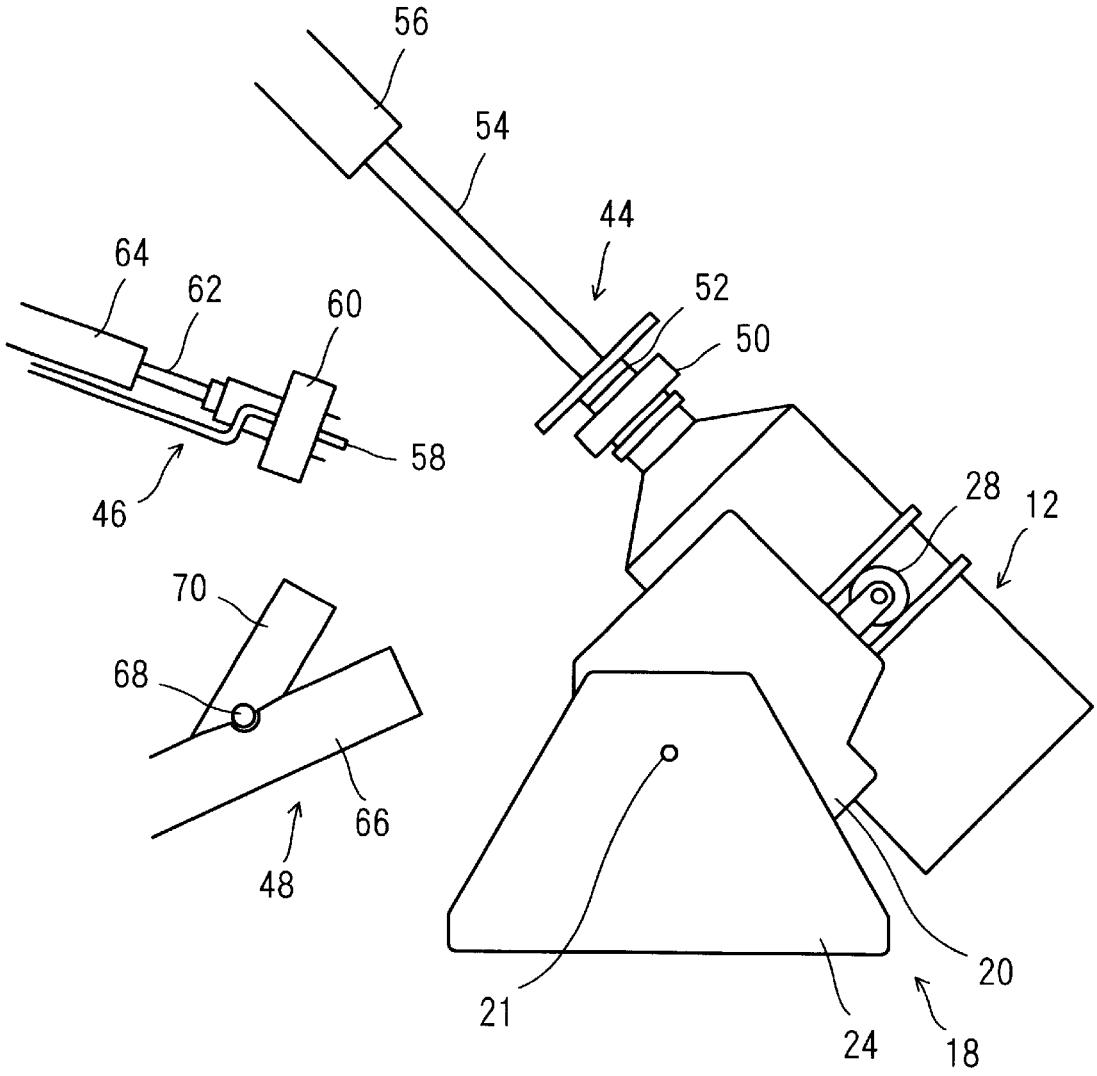
FIG. 4 is a side view showing an action of the embodiment shown in FIG. 1.

The mixing container 12 mounted in the rotating/rocking portion 18 is first tilted and stopped at a predetermined angle as shown in FIG. 4. The air cylinder 54 of the lid member holding portion 44 is extended, and the attaching/detaching portion 52 holds the lid member 50. Then, while the lid member 50 is held the air cylinder 54 is retracted, removing the lid member 50 from the mixing container 12.

Figure 5:
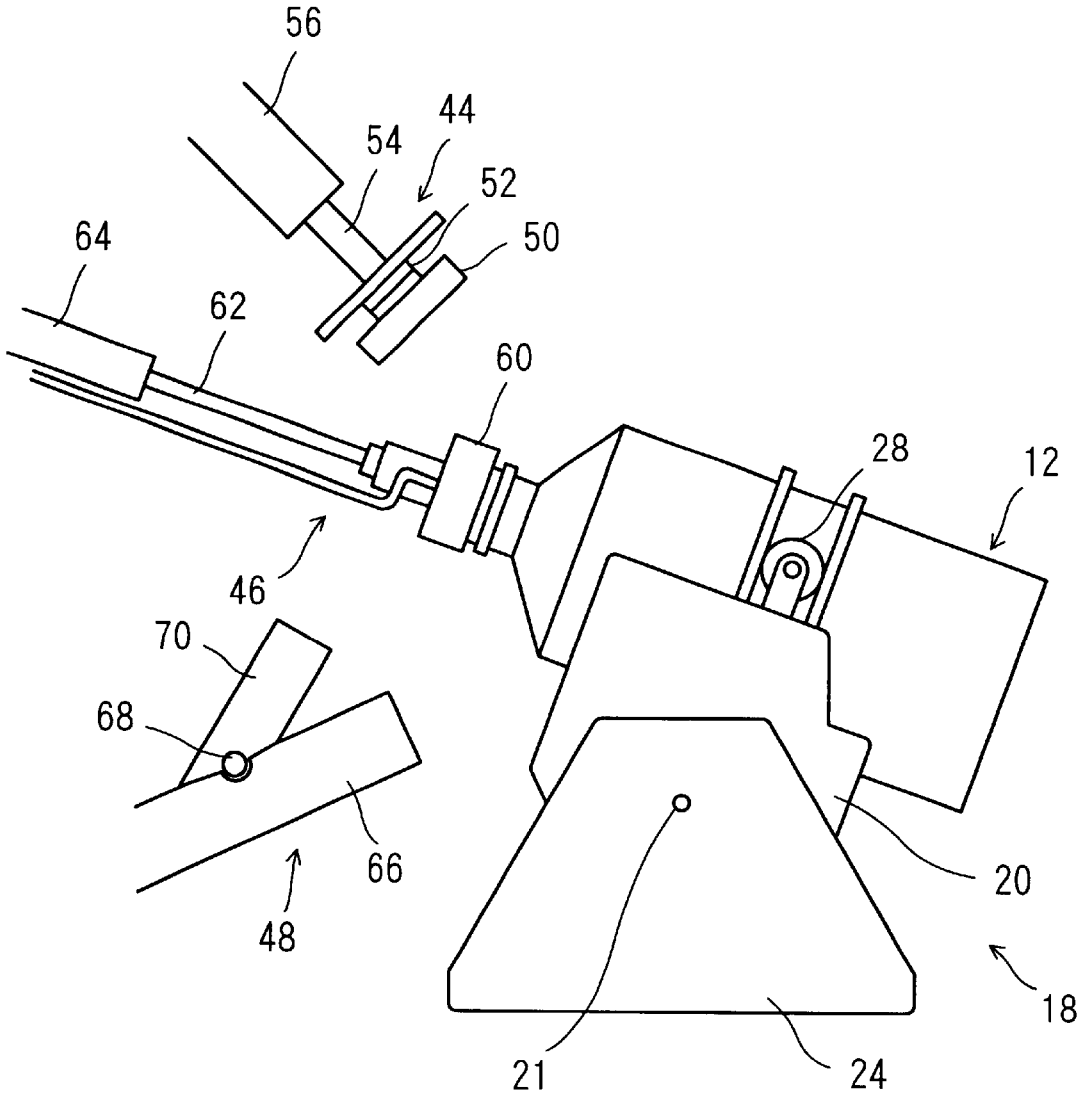
FIG. 5 is a side view showing an action of the embodiment shown in FIG. 1.

Then, as shown in FIG. 5, the tilting angle of the mixing container 12 is changed to align in the nozzle holding portion 46, the air cylinder 62 of the nozzle holding portion 46 is extended, the nozzle portion 58 is set to the opening 16, and the spraying port 74 is exposed to an inside of the mixing container 12. At this time, the tilting angle of the mixing container 12 should preferably be at 10 degrees~40 degrees off the horizontal level. At this tilting angle, the spray of the lubricant is started as described above. When the lubricant is sprayed toward a surface of the mass of metallurgical powder, it is important that the nozzle portion 58 is not directly contacted by the metallurgical powder and the spray does not hit directly an inner surface of the mixing container 12. More uniform mixing can be made by rotating the mixing container 12 while the lubricant is being sprayed. If the mixing container 12 is rotated while the lubricant is sprayed, first the mixing container 12 is started to rotate, and then the spraying of the lubricant from the nozzle portion 58 is started after a constant rotating speed has been reached.

As described above, since rocking operation is not performed while the lubricant is being sprayed, the metallurgical powder does not stick to the nozzle portion 58, and the nozzle portion 58 is not worn by the metallurgical powder.

Further, if the mixing container 12 is rotated while the lubricant is being sprayed, first the mixing container 12 is started to rotate and after a constant rotating speed is reached, the lubricant is sprayed from the nozzle portion 58, thereby making the supply of the lubricant more uniformly.

After the spraying of lubricant is finished, a mixing step is performed.

Figure 6:
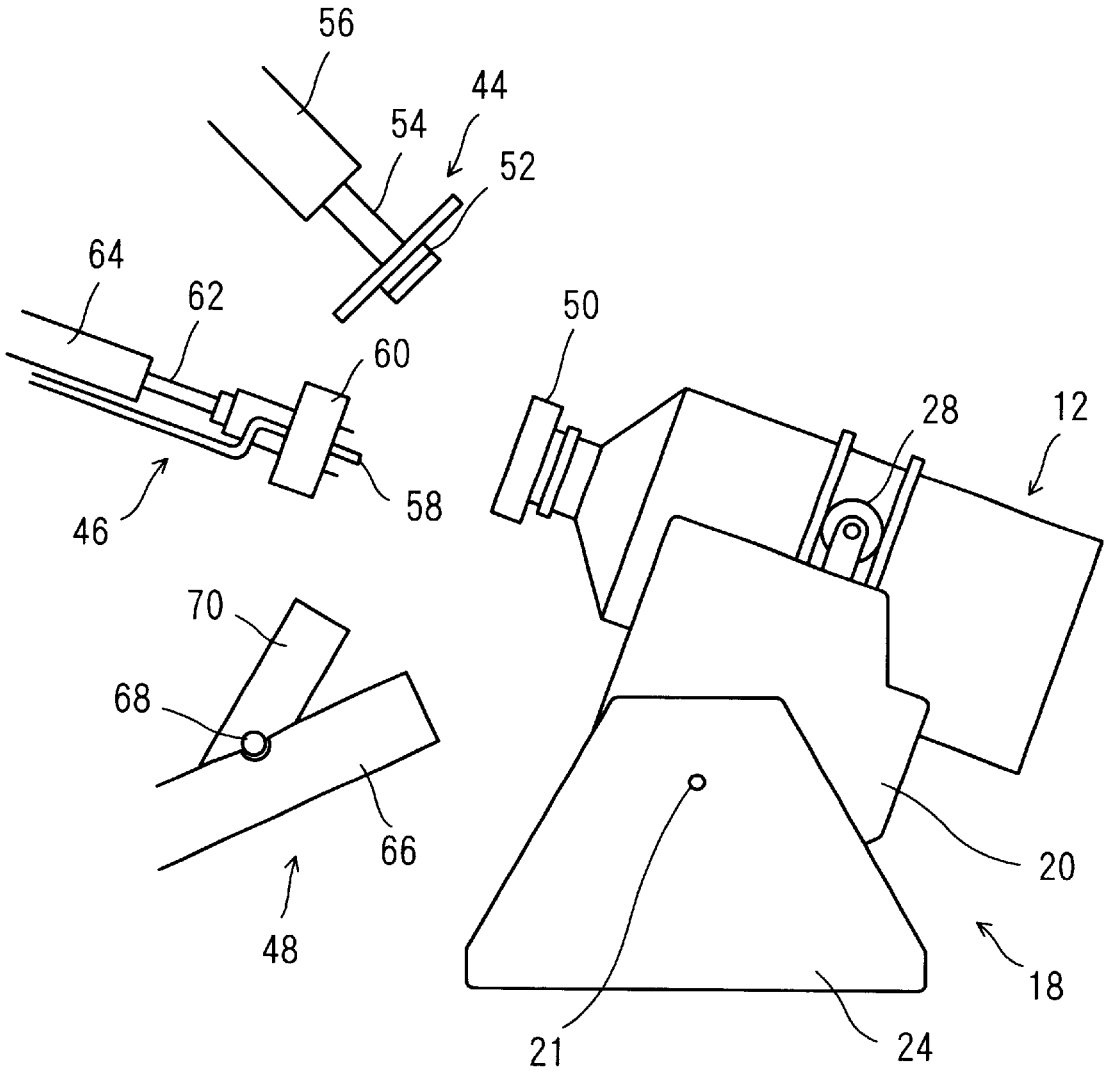
FIG. 6 is a side view showing an action of the embodiment shown in FIG. 1.

First, after the spraying operation is finished, the air cylinder 62 of the nozzle holding portion 46 is retracted, and the nozzle portion 58 is detached from the mixing container 12. Then, as shown again in FIG. 4, the mixing container 12 is tilted to an alignment in the lid member holding portion 30, then the air cylinder 54 of the lid member holding portion 44 is extended, and the lid member 50 having being held by the attaching/detaching portion 52 is attached to the opening 16. Then, as shown in FIG. 6, the mixing container 12 is rotated and rocked by the rotating/rocking portion 18, mixing the metallurgical powder and the lubricant in the mixing container 12.

As described above, by having separate steps of spraying and mixing, it becomes possible to prevent the powder from sticking to the nozzle portion 58 when the lubricant is supplied, making possible to supply the lubricant uniformly to the surface of the metallurgical powder. Therefore, it becomes possible to avoid non-uniform spray caused by the spraying port 74 of the nozzle portion 58 covered by the metallurgical powder, as well as preventing the lubricant from dripping out of the spraying port 74, preventing the powder from becoming localized doughy mass, making possible to mix the metallurgical powder with the lubricant efficiently and uniformly.

Further, the step of mixing the metallurgical powder with the lubricant is performed, with the nozzle portion 58 detached. Thus, the metallurgical powder does not stick to the nozzle portion 58, and the metallurgical powder does not wear the nozzle portion 58, making longer the life of the nozzle portion 58.

After the mixing step is complete, the mix is unloaded.

Figure 7:
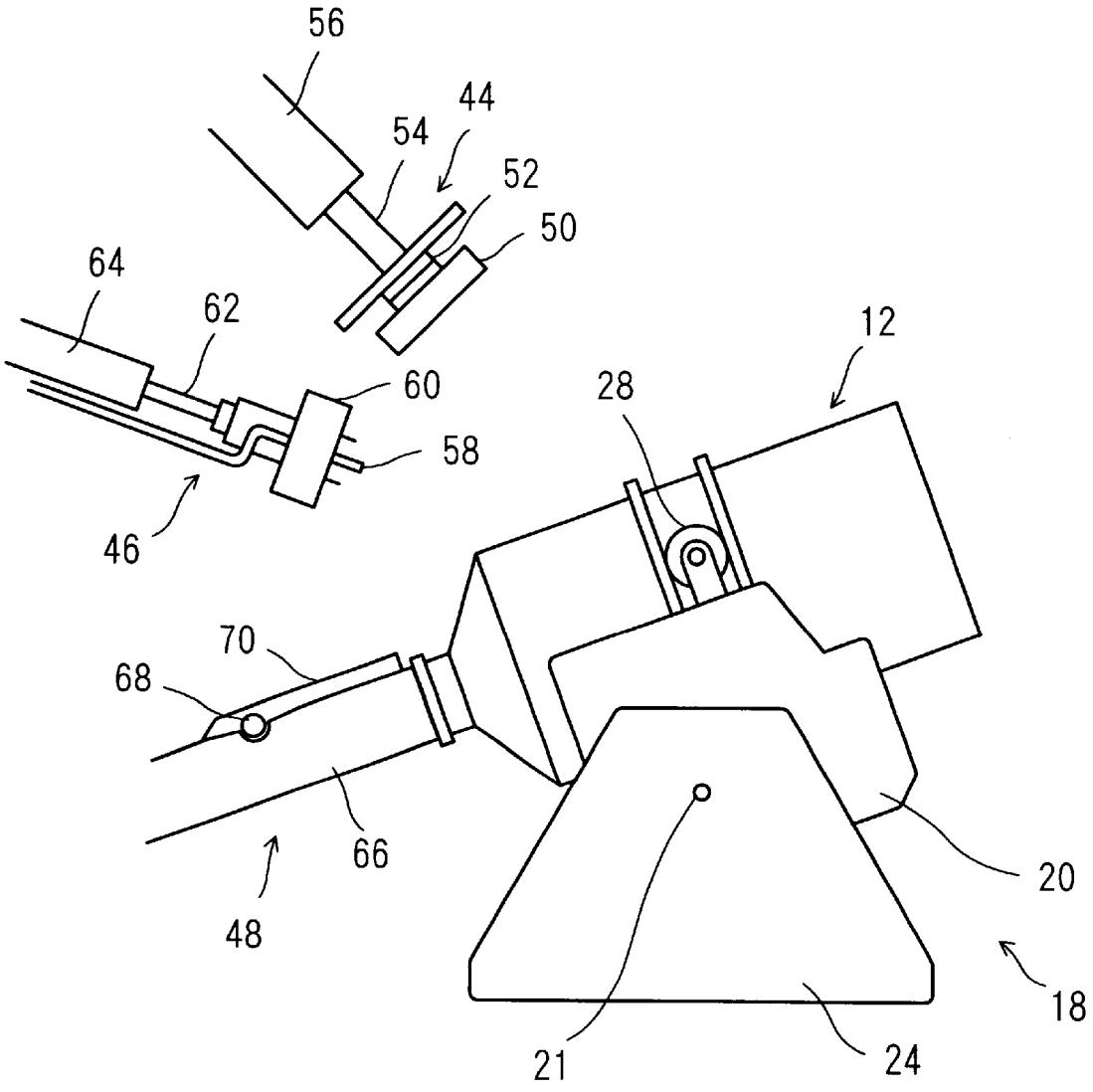
FIG. 7 is a side view showing an action of the embodiment shown in FIG. 1.

First, as shown is FIG. 4, the mixing container 12 is tilted to an alignment in the lid member holding portion 44. Then, the air cylinder 54 of the lid member holding portion 44 is extended, and the lid member 50 is held by the attaching/detaching portion 52. Then, while the lid member 50 is held, the air cylinder 54 is retraced, and the lid member 50 is removed from the mixing container 12. Then, as shown in FIG. 7, the tilting angle of the mixing container 12 is changed to an alignment in the unloading portion 48, so that the opening 16 comes above the chute portion 66, and pivoting portion 68 is driven to make the cover portion 70 provide covering above the opening 16. With the mixing container 12 held tilted as described above so that the opening 16 faces downward, the mixing container 12 is rotated. During this unloading step, the hammering mechanism 38 gives impact to the mixing container 12. By unloading the mix as described, by rotating the mixing container 12 while giving impact to the mixing container 12, the mix in the mixing container 12 can be taken out efficiently.

Since the metallurgical powder and the lubricant can be mixed uniformly as described above, it becomes possible to reduce breakage or cracking when the mix is pressed or sintered, making possible to improve yield of compacts and the sintered bodies.

Further, by providing the air cylinder 54 capable of attaching the nozzle portion 58 to the opening 16 of the mixing container 12 separately from the air cylinder 64 capable of attaching/detaching the lid portion 50 to the mixing container 12, it becomes easier to remove the nozzle portion 58 from the mixing container 12 at the time of mixing operation, making possible to prevent the metallurgical powder from sticking to the nozzle portion 58 during the mixing.

Experiment 1

Figure 8:
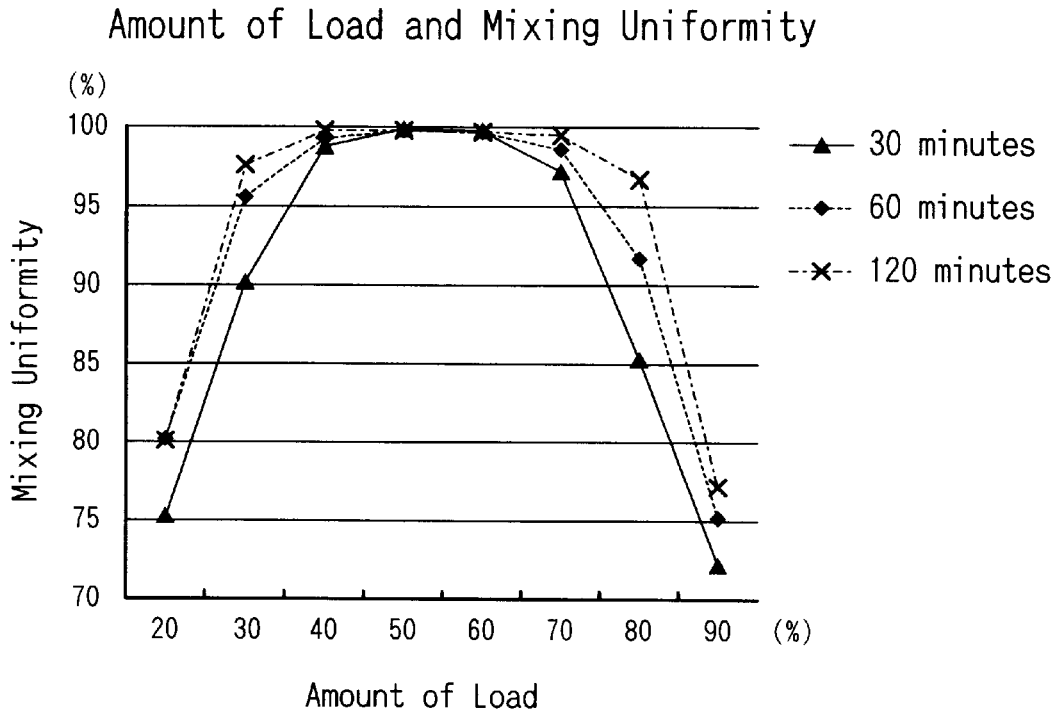
FIG. 8 is a graph showing characteristic relationships between the amount of load and mixing uniformity.

FIG. 8 shows a mixing uniformity when the amount of the metallurgical powder loaded was varied between 20% and 90% of the capacity of the mixing container 12. In this experiment, the mixing container 12 was tilted at 25 degrees off the horizontal level when the lubricant is being sprayed with rotating, and thereafter the mixing was performed with rotating and rocking operation. The mixing operation was performed for 30 minutes, 60 minutes and 120 minutes. The mixing uniformity was calculated as follows. Specifically, ten samples were taken from each mix after the mixing operation, and the amount of the lubricant contained for each of the samples was determined by gas chromatography. The average amount of lubricant contained per each of the ten samples was calculated, and then the difference between the average and the amount in each sample was calculated for obtaining a standardized deviation as representing the mixing uniformity.

As shown in FIG. 8, in each of the cases of 30 minutes, 60 minutes and 120 minutes, the lubricant is mixed more uniformly in the range of 30%~80% of the capacity of the mixing container 12, and more preferably in the range of 40%~60% thereof.

Experiment 2

Figure 9:
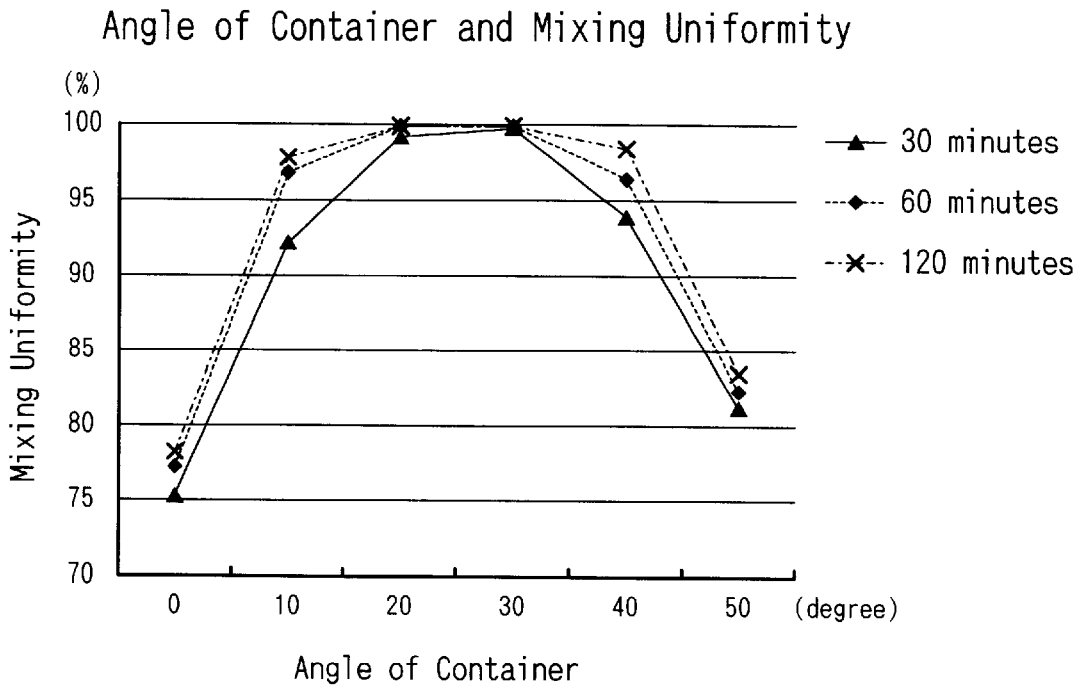
FIG. 9 is a graph showing characteristic relationships between an angle of the container and the mixing uniformity.

Next, FIG. 9 shows the mixing uniformity when the tilting angle of the mixing container 12 at the time of spraying the lubricant was varied from 0 degree to 50 degrees off the horizontal level. In this experiment, the amount of the metallurgical powder loaded was 25% of the capacity of the mixing container 12, and the spraying of the lubricant was made while rotating the mixing container 12. The mixing operation was performed for 30 minutes, 60 minutes and 120 minutes with rocking and rotating operation.

As shown in FIG. 9, in each of the cases of 30 minutes, 60 minutes and 120 minutes, the mixing uniformity decreases when the tilting angle of the mixing container 12 is too small or too large. The experiment shows that the lubricant is mixed most uniformly when the tilting angle of the mixing container 12 is within the range of 10 degrees~40 degrees off the horizontal level.

As exemplified as above, by optimizing the amount of the metallurgical powder to be loaded into the mixing container 12 and the tilting angle of the mixing container 12 when the lubricant is sprayed toward the surface of the powder, it becomes possible to spray the lubricant uniformly toward the surface of the metallurgical powder, making possible to uniformly mix the metallurgical powder with the lubricant.

It should be noted here that in the present embodiment, description is made for a case in which the metallurgical powder is used as the powder. However, the effect of the present invention is greater if the powder is a rare-earth alloy which is highly abrasive and therefore apt to wear the mixing container. Specifically, even when the rare-earth alloy powder is used, the nozzle portion 58 is not worn, and the life of the nozzle portion 58 can be made longer. The similar effect is obtained if the powder is not a metallurgical powder. The rare-earth alloy is used for manufacturing a magnet for example. The rare-earth magnet is manufactured as follows by using the mixing apparatus 10. Specifically, a raw material alloy is made as per (1) of the ninth paragraph in the U.S. Pat. No. 4,770,723. Next, the alloy is pulverized as per (2) of the paragraph. Then, the pulverized powder is mixed with a lubricant diluted with an organic solvent, by the mixing apparatus 10. Then, the obtained mix is compacted into a compact and sintered as per (3) and (4) of the paragraph to obtain the rare-earth magnet.

Further, according to the present embodiment, the lubricant is used as the liquid, but the liquid may be a binder. Further, the liquid to be mixed may be a liquid other than the lubricant or the binder.

The present invention being thus far described and illustrated in detail, it is obvious that these description and drawings only represent an example of the present invention, and should not be interpreted as limiting the invention. The spirit and scope of the present invention is only limited by words used in the accompanied claims.

What is claimed is:

1. A method for mixing a powder with a liquid, comprising:

a first step of supplying the liquid to the powder in a mixing container by a supplying portion exposed to an inside of the mixing container, and a second step of mixing the powder with the liquid by rocking the mixing container, wherein the mixing container includes an opening, and the method further comprising a third step after the second step, of unloading a mix from within the mixing container while giving the mixing container rotation and impact as well as tilting the mixing container to position the opening at a downward location.

2. The method according to claim 1, further comprising a step of evacuating the supplying portion from the mixing container before the second step of mixing the powder.

3. The method according to claim 1, wherein the first step further includes tilting the mixing container at 10 degrees–40 degrees off the horizontal level while the liquid is supplied to the powder.

4. The method according to claim 3, wherein the mixing container is hollow cylindrical having a length 1.5~2.5 times an inner diameter, and loaded with the powder to 30%~80% of the capacity of the mixing container.

5. The method according to claim 1, wherein the first step further includes rotating the mixing container while the liquid is supplied.

6. The method according to claim 1, wherein the first step of supplying the liquid to the powder includes a step of supplying the liquid, which includes at least either one of a lubricant and a binder, to the powder which includes a metallurgical powder.

7. The method according to claim 6, wherein the first step of supplying the liquid to the powder includes the step of supplying the liquid to the metallurgical powder which includes a rare-earth alloy.

8. The method according to claim 1, wherein the first step of supplying includes the step of supplying the liquid at substantially constant pressure from start to finish.

9. A method for mixing a powder with a liquid, comprising:

a first step of supplying, at substantially constant pressure from start to finish, the liquid to the powder in a mixing container by a supplying portion exposed to an inside of the mixing container;

a second step of mixing the powder with the liquid by rocking the mixing container, wherein the mixing container includes an opening; and a third step after the second step, of unloading a mix from within the mixing container while giving the mixing container rotation and impact as well as tilting the mixing container to position the opening at a downward location.

10. A method for mixing a powder with a liquid, comprising:

a first step of supplying, at substantially constant pressure from start to finish, the liquid to the powder in a mixing container by a supplying portion exposed to an inside of the mixing container;

a second step of mixing the powder with the liquid by rocking the mixing container; and a step of evacuating the supplying portion from the mixing container before the second step of mixing the powder.

11. A method for mixing a powder with a liquid, comprising:

a first step of supplying, at substantially constant pressure from start to finish, the liquid to the powder in a mixing container by a supplying portion exposed to an inside of the mixing container; and a second step of mixing the powder with the liquid by rocking the mixing container, wherein the first step further includes tilting the mixing container at 10 degrees–40 degrees off the horizontal level while the liquid is supplied to the powder.

12. A method for mixing a powder with a liquid, comprising:

a first step of supplying, at substantially constant pressure from start to finish, the liquid to the powder in a mixing container by a supplying portion exposed to an inside of the mixing container; and a second step of mixing the powder with the liquid by rocking the mixing container, wherein the first step further includes rotating the mixing container while the liquid is supplied.

13. A method for mixing a powder with a liquid, comprising:

a first step of supplying, at substantially constant pressure from start to finish, the liquid to the powder in a mixing container by a supplying portion exposed to an inside of the mixing container; and a second step of mixing the powder with the liquid by rocking the mixing container, wherein the first step of supplying the liquid to the powder includes a step of supplying the liquid, which includes at least either one of a lubricant and a binder, to the powder which includes a metallurgical powder.

* * * * *